US008943995B2

(12) United States Patent
Muller

(10) Patent No.: US 8,943,995 B2
(45) Date of Patent: Feb. 3, 2015

(54) DROPDOWN RAILING FOR WATERCRAFT

(76) Inventor: Peter A. Muller, Gattikon (CH)

( * ) Notice: Subject to any disclaimer, the term of this patent is extended or adjusted under 35 U.S.C. 154(b) by 50 days.

(21) Appl. No.: 13/261,327

(22) PCT Filed: Dec. 20, 2010

(86) PCT No.: PCT/CH2010/000320

§ 371 (c)(1),
(2), (4) Date: Sep. 10, 2012

(87) PCT Pub. No.: WO2011/079401

PCT Pub. Date: Jul. 7, 2011

(65) Prior Publication Data

US 2013/0000542 A1 Jan. 3, 2013

(30) Foreign Application Priority Data

Dec. 22, 2009 (CH) ..... 1974/09

(51) Int. Cl.

| | |
|---|---|
| ***B63B 17/04*** | (2006.01) |
| ***B63B 27/14*** | (2006.01) |
| ***B63B 23/32*** | (2006.01) |
| ***B63B 27/30*** | (2006.01) |

(52) U.S. Cl.

CPC ..... *B63B 23/32* (2013.01); *B63B 27/14* (2013.01); *B63B 27/30* (2013.01)

USPC ..... 114/362; 182/86; 182/97

(58) Field of Classification Search

USPC ..... 114/259, 343, 362, 364, 365, 366; 182/86, 97, 194, 206

See application file for complete search history.

(56) References Cited

U.S. PATENT DOCUMENTS

| | | | | |
|---|---|---|---|---|
| 4,724,925 | A * | 2/1988 | Ritten | 182/97 |
| 5,133,275 | A * | 7/1992 | Maurizio | 114/259 |
| 5,690,045 | A | 11/1997 | Gauthier | |
| 5,794,292 | A | 8/1998 | Ricci, Jr. | |
| 5,823,132 | A | 10/1998 | Donavon | |
| 6,327,992 | B1 | 12/2001 | Martin | |
| 6,782,842 | B1 * | 8/2004 | Alvord | 114/259 |
| 6,789,648 | B2 | 9/2004 | Cook | |
| 7,121,226 | B2 | 10/2006 | Grimaldi | |
| 7,707,955 | B1 * | 5/2010 | Johns et al. | 114/259 |
| 2007/0101516 | A1 | 5/2007 | Carrigan | |

FOREIGN PATENT DOCUMENTS

| | | | |
|---|---|---|---|
| DE | 196 02331 | A1 | 7/1997 |
| WO | WO 2009/062331 | A2 | 5/2009 |
| WO | WO 2009/084046 | A1 | 9/2009 |

* cited by examiner

*Primary Examiner* — Lars A Olson
(74) *Attorney, Agent, or Firm* — Oliff PLC

(57) ABSTRACT

The invention comprises of a railing (1) which is foldable or and height adjustable or and extendable lengthwise and has rungs (5) or pivotable safety footsteps (14*a*) which, if necessary, can be kept in the vertical position (V) or horizontal position (Q) or and when tilting down the railing (1) remain in a stable position. The railing (1) has technical mean (4*a*,40, 43*a*,45*a*,51) as well as an emergency mean (10,11) and can if necessary take up a tender (42) and other objects and the footsteps (14) can be transparent for example to improve visibility to the rear.

10 Claims, 3 Drawing Sheets

DROPDOWN RAILING FOR WATERCRAFT

This application claims priority of PCT application PCT/CH2010/000320 having a priority date of Dec. 22, 2009, the disclosure of which is incorporated herein by reference.

TECHNICAL FIELD

The invention is based on a railing which serves as a ladder or stair and as an aid for watering or collecting a tender and other technical means.

BACKGROUND OF THE INVENTION

Dropdown platforms especially for swimmers, divers and for tenders are known as described in the patents DE 196 02 331, U.S. Pat. No. 6,327,992, U.S. Pat. No. 5,690,045. These enable persons or material to be let down into the water or brought on board.

In the case of yachts extendable stairs from the stern or from the swim platform are known as described in U.S. Pat. No. 6,789,648 B2 or parts of the swim platform are let into the water in an arc on which carry stair elements as described in U.S. Pat. No. 7,121,226 B2.

SUMMARY OF THE INVENTION

The invention involves that, on a watercraft with a swim platform, a railing is fixed, which, at the same time, can be folded down or and lowered so that the railing can be folded down horizontally into a swim platform or lowered down to under the waterline. The railing has rungs so that when lowering it under the waterline these can be used as foot rest elements and serve as a ladder, or instead of rungs having pivotable step elements that can be built into the railing. When tilting the railing from a vertical into a horizontal position, it becomes an additional platform and when tilting down the railing further then it is converted into a convenient stair. An emergency press button can be activated even when in the water. Furthermore such a railing is usable on watercrafts which are equipped with an outboard motor. Such type of watercraft do not have lavish bathing platforms as the outboarder is in the way and needs a large tilting angle at the rear so therefore mostly only narrow pedestals with a narrow ladder are available.

For safety reasons especially in the case of larger watercraft an additional railing is fixed on the bathing platform so that guests on board can move safely on the platform. This is similar to a railing on a balcony which prevents the guests from falling out and in choppy seas gives the psychological feeling of safety, too.

More and more larger bathing platforms are becoming fashionable for smaller watercrafts which are just fixed at the stern of the watercraft. A smaller watercraft rolls much more and pitches than a large heavy ship. In the case of such vessels a railing makes even more sense. The invention makes use of the usual placement of such a railing on the bathing platform and increases the function by means of a tilting or and height adjustable mode, so that the railing can be used on one hand as an additional platform as well as a lavish ladder, i.e. by means of the pivotable footsteps, classified as a stair to enable the comfortable getting in and out of the water. When the railing is partially folded then this can be used as a gangway, too, especially practical when in connection with the horizontal shifting of the railing. The railing can be used as well as an assistance for small tenders, diving gear etc., for example with the possibility of shifting a tender from the swim platform directly onto the railing which is folded down horizontally by using rails and sledge and thus to lower the tender into the water and heave it again on board without using muscle power.

A central point on the tilting, respectively the folding mechanism is that, should a person or part of the body get trapped in the movable parts, then in this case there is a mean available to minimize damage and should someone fall from the stern area accidentally into the water, then the person can help himself to get on board again by tilting down the railing by using an emergency lever, i.e. letting the railing down into the water. This is secured by an emergency switch which is directly connected to the watercraft's battery. The railing can also be brought into action mechanically by means of a cable which looks similar to a handstarter on a lawnmower or small outboarder so that the involuntary swimmer can climb up the lowered or folded down railing and get on board again by himself.

Core of the invention is to increase the usual safety function of a railing by means of a foldable, respectively dropdown and height adjustable railing, so as to have the possibility of having a larger swim platform with the additional functions of a ladder or stair for a comfortable getting into or out of the water, as well as having a gangway or a lavish ladder and platform mean on a watercraft with an outboard motor, as well as an assistance for bringing technical mean on board the watercraft. An emergency use of the railing outside the craft is also ensured.

BRIEF DESCRIPTION OF THE DRAWINGS

Various exemplary aspects of the invention will be described with reference to the drawings, wherein. Similar elements are named in the various figures with the same references.

DETAILED DESCRIPTION OF THE PREFERRED EMBODIMENTS

Figure 1:
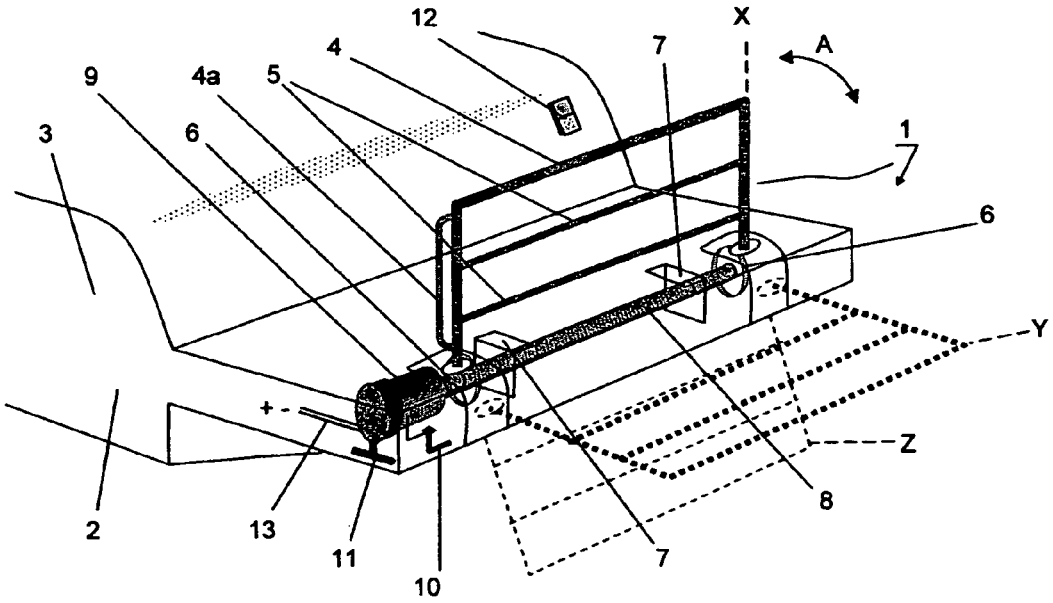
FIG. 1 A schematic 3D view of a tilting railing on the swim platform with a U-shaped frame and in between appropriate rungs, a swivel mechanism, a swiveling drive, a switch and an emergency switch, as well as an emergency cable FIG. 2 A schematic 3D view of a tilting railing with pivotable footsteps FIG. 3 A schematic side view of a pivoting safety footstep with a safety controller and a snap locker equipped with a spring element FIG. 4 A schematic side view of a swiveling safety footstep on a tilting railing with a swiveling or linear drive and a gear, a cog wheel and a gear engine with rotary encoders, a controller and rpm counter FIG. 5 A schematic side view of a tilting railing on a swim platform and a shiftable and lowerable and mean, a cylinder and a holding bar with a cable which firmly connects the end of the tilted down railing, as well a hinged basket FIG. 6 A schematic side view of a tilting railing on the swim platform and a lowerable and shifting mean, two linear drives and a tender, its chock, a sledge and rails FIG. 7 A schematic side view of a tilting railing behind an outboard motor, fixed to the transom of the watercraft by means of a holding arm and with a transmitter as well as a lifting body Only essential elements of the invention are schematically shown to facilitate immediate understanding.

FIG. 1 shows a schematic 3D view of a tilting railing 1 on the swim platform 2 which is fixed to a watercraft 3, whereby the railing 1 has a U-shaped frame and in between there are rungs 5 and the frame 4 is connected with a swivel mechanism 6, which is fixed on the swim platform 3 by means of a holding mean 7. The swivel mechanism 6 is on one hand connected to the opposite swivel mechanism 6 by means of a synchronization bar 8 and on the other hand to the swiveling drive 9, which has an emergency switch 10 as well as an emergency pull rope 11.

Basically it is a frame 4 shaped as an inverted U on a swim platform 2 and if made out of metal, preferably stainless steel tube, has a high mechanical stability and optically as well as in functionality, represents a railing 1. In heavy seas bathers, going from the cockpit to the back onto the swim platform 2, have to be afraid or in the case of balance loss that they cannot find a suitable place to hold themselves, respectively at the stern of the watercraft 3 or on a suitable protruding mean: therefore the railing 1 is a suitable mean to give guests on board a watercraft 3 the safety and so the swim platform 2 becomes a favored meeting point next to the water. Accordingly, rungs 5 embedded in frame 4 are, in the standard railing 1, considered as an additional safety mean, so that for example children and objects, that are on the swim platform 2, cannot fall overboard and the small ones can hold onto the frame 4 or rungs 5 in choppy sea.

The invention utilizes the basic position of the railing 1 on a watercraft 3, in that the frame 4 is not as usual, firmly fixed to the swim platform 2, but is firmly attached to a swivel mechanism 6. The holding mean 7 mounted under the swim platform 2 supports and appropriately stores the swivel mechanism 6 according to State of the Art. The swivel mechanism 6, one of each is fixed on each side of the frame 4, are in addition connected with each other by means of a synchronization bar 8, so that the swiveling drive 9, which is also fixed on the holding mean 7 or possibly on the underside of the swim platform 2, activates the swivel mechanism 6. When activating the swiveling drive 9 both swivel mechanisms 6 move parallel and consequently execute a tilting movement on frame 4 according to arrow A, i.e. on the railing 1. The swiveling drive 9 can be an electric motor with a self-locking worm gear, or a fluid motor or a linear fluid or an electric cylinder, whereby all swiveling drives are kept in their self-locking position when inactive or are locked. Instead of a synchronization bar 8 the use of two swiveling drives 9 is also conceivable, which can hold the rotation angle of both swiveling drives 9 synchronously by means of sensors, as for example rotary encoders and a controller.

Figure 2:
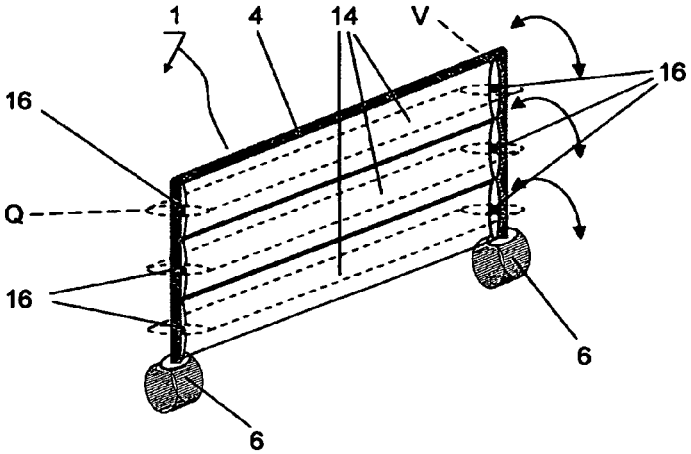

Thereby the railing 1 can be tilted into every position by means of up/down switch 12, when using a lockable gas spring cylinder the locking is cancelled by a release cable on the gas spring cylinder and accordingly can be tilted from the home position X, via the horizontal position Y, to the stair position Z. In the stair position Z, the attached rungs 5 are converted to a ladder for the safety of children or objects and the rungs 5 are appropriately formed, so that bathers can get comfortably in and out of the water. Not shown is the position "gangway" which is between the home position X and the horizontal position Y and can be of advantage when the stern of the watercraft 3 is directed towards the pier and therefore by using the railing 1 similar to a leaning ladder, for example an elevated harbor footway, can be easily reached, whereby the gangway function with the pivotable footsteps as described in FIG. 2 is even more comfortable to use.

The railing 1 has in addition an emergency function. When it stands in the vertical standard position X and should somebody unexpectedly fall into the water and nobody is on board to help and no getting up mean is available, then the emergency switch 10 can be pulled which assures a separate power contact to the swiveling drive 9 and by means of a separate current wire 13 has direct access to the board batteries, therefore allowing the railing 1 to be tilted down motorized.

Alternatively, to successfully avoid the risk of electrical failure, by means of an emergency pull rope 11 the engine of the swiveling drive 9 can be pulled using the spring loaded elements of the emergency pull rope 11 lying in the housing and therefore for example, using a worm gear, by repeated pulling on the self-winding emergency pull rope 11 the railing 1 gets tilted down, enabling the person overboard to go up the rungs 5 himself and safely reach the top of the swim platform 2. In this connection it is conceivable that especially in choppy seas the frame 4 has at the same time one or a second handle **4*a* so as to be able to have a firmer grip on the rungs 5 to climb up the footsteps 14, as shown in FIG. 2**.

By using a fluid motor or a linear fluid cylinder, a hand pump or and a pressure reservoir with an emergency valve can be fixed under the swim platform 2 and with this feature the railing 1 can be tilted down.

This inventive emergency function can also be used on existing electrically or hydraulically operated stairs and other technical mean on the market.

FIG. 2 Shows a schematic 3D view of a tilting railing 1 with pivotable footsteps 14 that can be accordingly swiveled on the pivot shaft 16. This solution has the advantage that it gives a more convenient and even better foothold on each of the footsteps 14 as well as on the rungs 5 and the tilted railing 1 no longer feels like a ladder but like a real stair. By means of a pivoting mechanism as described in FIG. 4, when not in use, the footsteps 14 can either remain in the vertical position V, or when in use can be pivoted into the horizontal position Q. In the home position X the footsteps 14 are space saving and for optimal safety placed vertically and when using the railing 1 as a stair, then they are put into the horizontal position Q. In the horizontal position Y of the railing 1 the footsteps 14 are also placed horizontally and thus automatically form an enlarged platform surface. When water skiing, the footsteps 14 can be put in the horizontal position—in the vertical home position X of the railing 1—so as to be able to thread the skiing rope attached to the stern of the water craft 3 easily between the frame 4, respectively footsteps 14. A further technical advantage is to keep the footsteps 14 in the vertical position becoming a fully covered area, so that persons and objects are even more protected from slipping into the water and at same time is a wind barrier.

For safety reasons is the use of transparent footsteps 14, too. In addition to the aesthetic look of a for example heavy chromed frame 4 with the inlaid transparent footsteps 14, this has also distinct advantages regarding the rear view, whether it be when docking, or when pulling a water skier etc. In addition, on one or several footsteps 14 for example the name of the boat can be clearly etched or by means of LED lamps the name can be made visible and in the dark create a great atmosphere with the various points of light.

Figure 3:
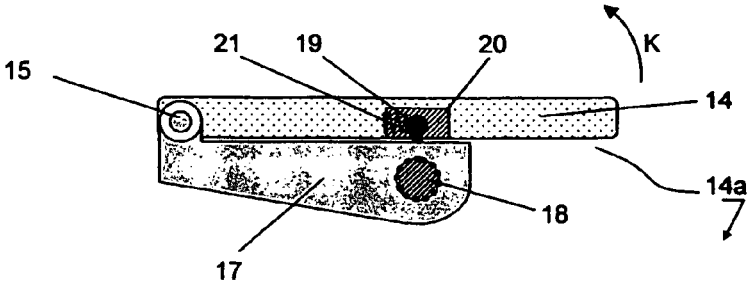

FIG. 3 Shows a schematic side view of a safety footstep **14*a* with a safety hinge 15 and a spring loaded snap lock 19, 20, 21. As is the case with all motorized means, there is the risk of trapping a finger or toe in the footstep 14 when bringing up the railing 1, despite a note in the manual warning not to go onto the railing during the tilting movement A. If the manual is not adhered to, it could have traumatic consequences, which by means of a safety footstep 14*a* certainly can be avoided, as this with a safety hinge 15, one of which is placed on the side of a safety footstep 14*a*, is fixed to the respective pivot mean 17. The pivot mean 17 has on the one side a toothed axis 18 which is inserted with the pivotable mechanic into the frame 4 and on the other side a head 19 is fixed onto it, which is pressed into a retainer 20 with a spring 21**, but can be released under load and is based on the permissible load of non-destruction of human tissue and bone.

Should the load limit be exceeded if an object is trapped between the two footsteps 14, then this tilts up according to arrow K and neither injures nor damages the trapped mean nor damages the mechanic of the pivotable footstep 14. Of course, the safety hinge 15 is also able to be released when there is adequate load e.g. of a brace which is not shown here or with an identical construction similar to the snap lock 19,20,21, especially in the case the railing 1 is used as a gangway.

Figure 4:
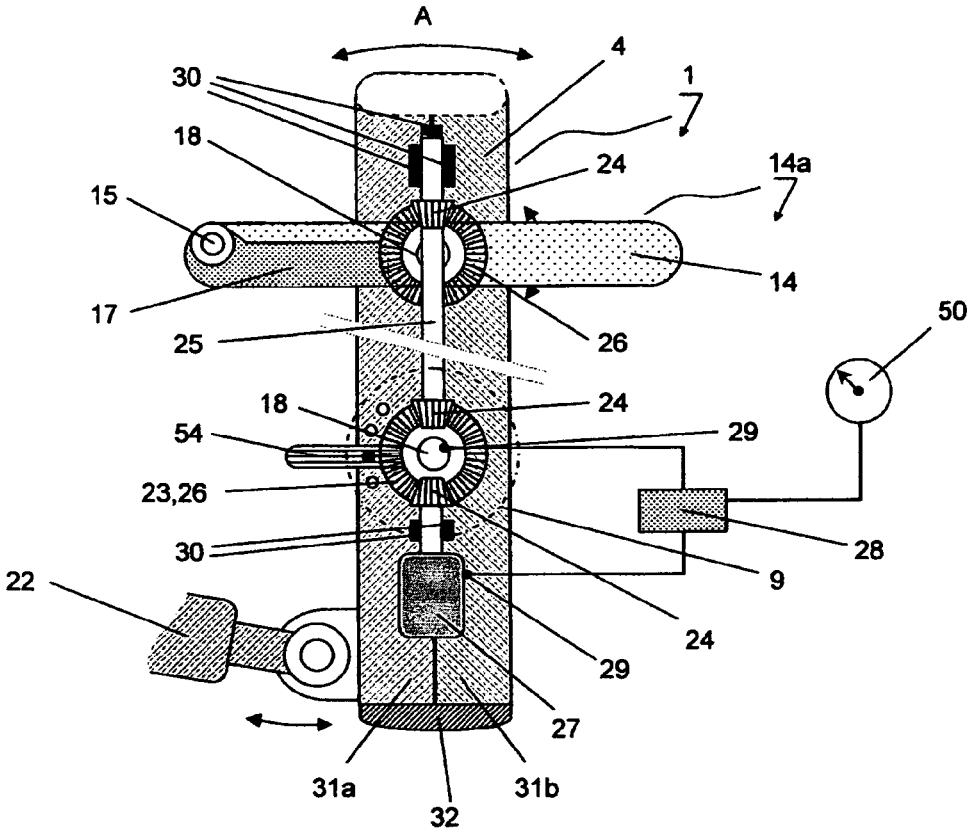

FIG. 4 Shows a schematic side view of swiveling safety footstep 14*a*, which, by means of a swiveling drive 9 or by means of a linear drive 22 achieves a tilting movement of the railing 1, according to arrow A, at the same time the safety footstep 14*a* by means of two cylinder versions during the titling procedure are kept in a constant angle position. Swiveling the safety footstep 14*a* can be achieved in the first version by means of a cog wheel 23 by means of a forced adjustment mean, in which a small wheel 24 meshes which is part of a pivoting shaft 25 and has one or more additional small wheels 24—corresponding to the number of footsteps 14—and are connected to the axis 18, meshing to the large wheel 26. In case the frame 4 is activated by a power mean e.g. the swiveling drive 9 or the linear drive 22, the safety footsteps 14*a* stay constantly in the horizontal position at a corresponding gear transmission by means of forced adjusted element on the cog wheel 23. The safety footsteps 14*a* can be twisted manually from the vertical to the horizontal position or vice versa by means of e.g. a snapping in lever 54, to safeguard the position, which twists the safety footsteps 14*a* by a 90 degree angle. When using the railing 1 as the safety footsteps 14*a* from the initial vertical and lean position, the footsteps 14 have to be brought first into the horizontal position before the automatic angle holding of the footsteps 14 takes place.

The second version to keep the horizontal position of the safety footstep 14*a* by simultaneously tilting the railing 1 is ensured by a swiveling motor 27. By pressing the up/down switch 12, the controller 28 is activated first, which detects the exact angle position provided by the rotary encoder 29. One of the rotary encoders 29 measures the angle of tilting of the frame 4, the second rotary encoder 29 measures the turn of the axis 18 or another part of the safety footstep 14*a* as a feedback to the controller 28, so that the set point is kept during the tilting movement A. The tilting angle of the frame 4 is the base value for the controller 28 to determine the angle of the safety footstep 14*a*.

In the case the safety footstep 14*a* is in the vertical position, it will be twisted firstly into the horizontal position by means of e.g. a swiveling motor 27, afterwards the frame 4 tilts down by means of swiveling drive 9 or linear drive 22, according to arrow A. During this process the swiveling motor 27, according to the data of the rotary encoders 29, navigates the pivoting shaft 25 always so far that, by means of the wheel sets 24,26, all safety footsteps 14*a* stay synchronously in the horizontal position. Instead of a rotary encoder 29 placed on the swiveling motor 27, this can also be an impulse counter motor and count these values which are forwarded to the controller 28 for processing.

The swiveling motor 27 is ideally equipped with a worm gear so that when the swiveling motor 27 is not activated, the safety footstep 14*a* remains in position even under load. With the switch 12 it is also conceivable that other commands can be given directly to the railing 1, as for example for the mode "platform". In this case the safety footsteps 14*a* will not be swiveled but only the frame 4 is tilted into the position Y and so the requested platform position is available without further activations. In addition the controller 28 can also be connected to the rpm counter 50 of the watercraft's engine, so that only a small engine speed, respectively watercraft 3 speed is feasible with a lowered railing 1 in order to protect the system from high water flow impact. When cruising the controller 28 controls the position of the railing 1 and should the set value not be any more in line, the system corrects the position back to the allocated initial position.

The controlled swiveling of the safety footstep 14*a* by means of the wheel set 24, 26 can also be preferably achieved by crown wheels with the advantage that the pivoting shaft 25 with the small wheel 24 does not have to be shimmed to the large wheel 26, which in this case is a crown wheel, which means that the shaft bearing 30 of the pivoting shaft 25 is simplified as well.

The assembly of the wheel sets 23,24,26, respectively 24,26, shaft bearing 30, rotary encoder 29 first take place outside frame 4, in a inner housing 31, which represents a cylinder, divided into two inner shells 31*a*, 31*b* and can be made of e.g. synthetic material and therein the large wheels 26, pivoting shaft 25 with the small wheels 24, shaft bearing 30, further bearing and sealing elements, possibly even the swiveling motor 27 can be inserted and the inner shells 31*a*, 31*b* can be connected to each other watertight. After then the inner housing 31 is inserted into the frame 4, which represents a tube and positioned in such a manner that the axis 18 are aligning to the frame 4 and the inner housing 31 and afterwards the components are closed with a watertight cover 32. The inner housing 31 can be made out of one piece as long as the density of the shifting mimic regarding the safety footstep 14 is safeguarded. Instead of such a gear construction it is also conceivable that on the large wheel 26 an appropriately placed steering rack is fixed and the swiveling motor 27 performs a linear movement by means of a self-locking spindle and a rotary encoder 29 is possibly fixed to the latter.

Figure 5:
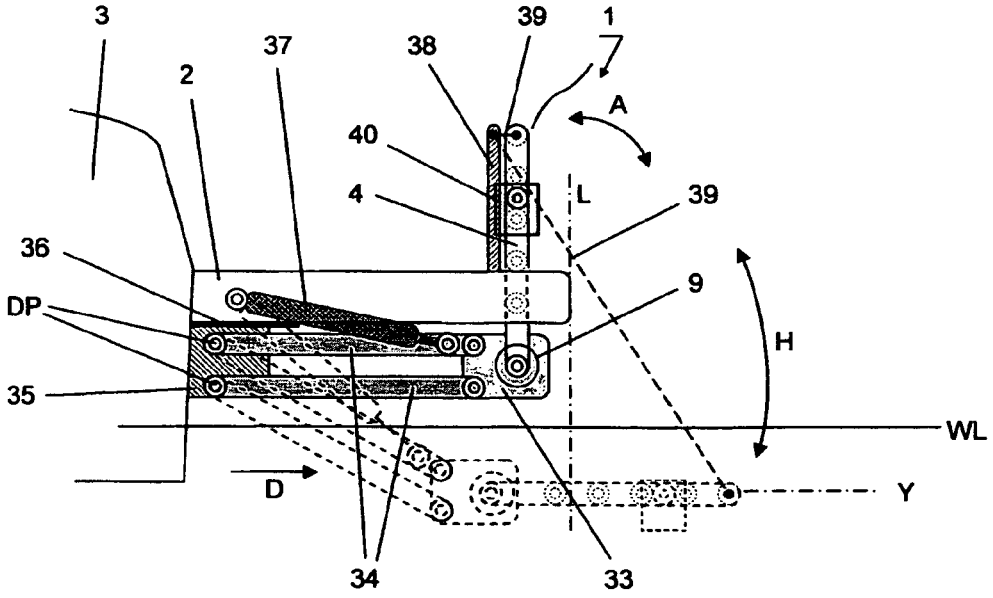

FIG. 5 Shows a schematic side view of a tilting railing 1, fixed and hinged to a swiveling plate 33, whereby the swiveling plate 33 is fixed to a parallelogram 34 which is connected to the console 35. The console 35 is either mounted on the stern of the watercraft 3 or on the swim platform 2 and can be moved horizontally under the swim platform 2 by means of rails 36, according to arrow D. A cylinder 37, mounted on the watercraft 3 or on the swim platform 2 is connected with the parallelogram 32 or the swiveling plate 33. With the appropriate keyboard of the switch 12 the railing 1 can in this way have an additional function, for example as a dropdown platform to enabling bathers to get comfortably into the water or also for lowering heavy equipment, as for example a tender, diving scooter etc. into the water and then lifting these back again on board. The railing 1 can be folded into the requested position as shown in the aforegoing FIG. 1-4 for example by means of a swiveling drive 9, shown here in the horizontal position Y by the broken lines and when activating cylinder 37 the railing 1 goes down according to arrow H for example under the waterline WL. Because of the swiveling movement and the elevated pivoting point DP of the parallelogram, the standing space, which might be a platform, on the safety footsteps 14*a* is shortened in connection to the swim platform 2 as shown by the perpendicular line L. Therefore it is preferable to have the console 35 slidable on a rail 36, which is attached to a separate carrier or on the swim platform 2. With the piston thrust of cylinder 37 it pushes the swiveling plate 33 not only downwards but also forwards and thereby the console 35 is also pushed forwards by the rail 36 and the railing 1 can be positioned without space loss i.e. perpendicular to the swim platform 2 under the waterline WL.

In addition on the swim platform 2 a releasable holding bar 38 can be fixed which enables an easier getting in and out of the water and can have a feature for fixing a holding rope 39 to it which can be connected to the frame 4. The holding rope 39 can have an automatic winch mechanism and can be pulled tightly. Furthermore a hinged, lockable holder 40 can be fixed on the frame 4 in order to pick up technical mean, such as diving gear, diving scooters etc. and when tilting the railing 1, the contents in the holder 40 are kept in a stable position. When the railing is not in use, the holder 40 nevertheless remains locked so as to avoid an uncontrolled oscillation of the holder 40 and its contents.

Figure 6:
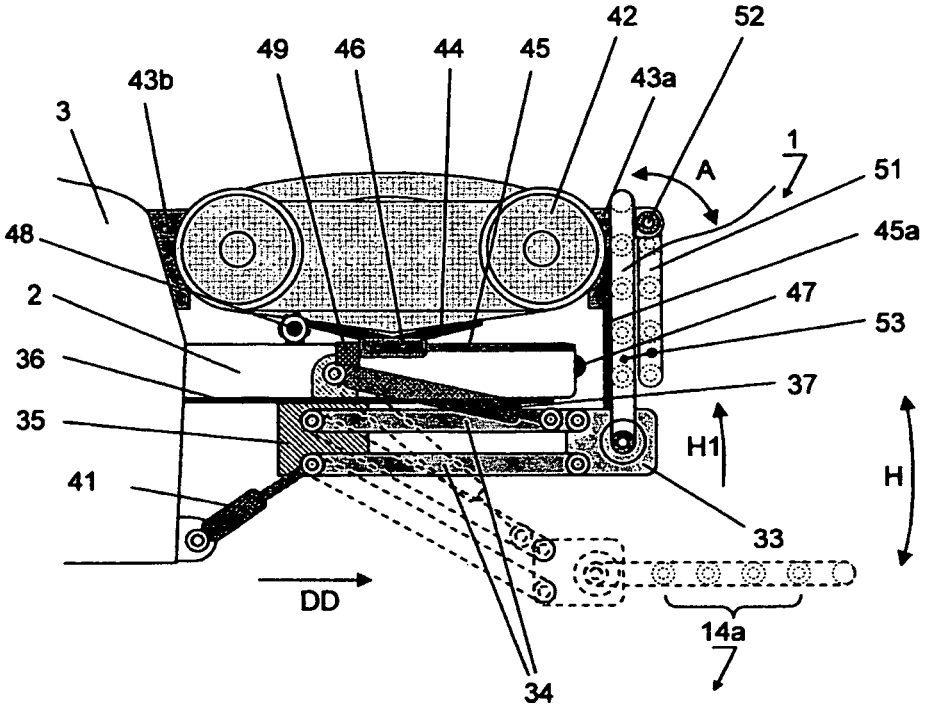

FIG. 6 Shows a schematic sideview of a tilting railing 1, which is hinged and fixed to a swiveling plate 33, whereby the swiveling plate 33 is fixed to a parallelogram 34, which is connected to the console 35, identical to FIG. 5. In this depicted configuration the cylinder 37 is connected to the console 35, so that the console 35, by means of a pusher 41 and the rail 36 can be operated horizontally over a predetermined distance as per arrow DD, which means the stroke and tilting mechanism of the railing 1 can be shifted horizontally from the cylinder 37 right up to the frame 4 and can be locked at any required position. The pusher 41 can be an electric or fluid mean and can be activated by a gear rack or chain or rope or cylinder and so on. By means of the stroke sensors not shown here, a straight-line stroke H instead of an arched stroke H can be achieved by means of the controller 28. The horizontal shifting of the railing 1 serves in addition, for example, to put a tender 42 on the chocks 44, by means of holding mean 43*a* mounted on the frame 4 and by the same holding mean 43*b* to hold it on the watercraft 3 irrespective of the width of the tender 42, similar to a jaw vice. The holding mean 43*a* can be fixed above the tender 42. For this purpose the cylinder 37 is activated to ensure that the railing 1 is clamped with a firm grip when being lowered as per arrow H. If no tender 42 is on board, then the railing 1 can be shifted to the swim platform 2 and using the further advantages of the tilting railing 1.

To put and get a tender comfortably in and out of the water, a tender rail 45 is fixed on the swim platform 2 so that the tender 42 lying on the chock 44 having underneath the tender sledge 46, can be smoothly shifted by power mean or manually. In addition on the frame 4 there is another tender rail 45*a*, placed in such a way that the tender sledge 46 can be shifted back and forth from the tender rail 45 onto the tender rail 45*a*. Should the swiveling plate 33 lie in an unfavorably position to the swivel mechanism 6 as visualized in this picture, i.e. positioned too low, the lifting mechanism 33,34,35 can be driven up by means of cylinder 37 as per arrow H1, so to level out the stroke height, assisted by means of a sensor 47, which can detect the clearance between the swim platform 2 and frame 4 as well as the misalignment of both mean to each other, so that both of the tender rails 45,45*a* are brought together on the same height and with the smallest gap.

Should the tender 42 move horizontally by power-operation due to the separately lockable tender sledge 46 on the tender rails 45, 45*a*, then the tender drive 48 can be driven hydraulically or electrically. In the electric version the tender drive 48 has for example a watertight rechargeable battery and after using the tender sledge 46 the recharging is done by means of a wire from the watercraft 3 or by induction power from the docking station 49 which is on the swim platform 2 or at the stern of the watercraft 3. Of course, the tender drive 48 can also be tethered, but is less practical and a trip hazard. Depending on the craft the railing 1 can in some cases be not long enough for a comfortable getting into and out of the water. Therefore, an extra extendable railing 51 is mounted, which is fixed to the upper end of the railing 1 by a hinge 52 and can be locked by lock 53. Should the railing 1 now be folded downwards, then the lock 53 can already be opened in advance and so when extending the railing 1, according to arrow A, the extendable railing 51 folds out automatically with it and can be locked again at the end, which can also happen automatically. The extendable railing 51 also has walk on steps 5 or footsteps 14. A telescopic extendable railing 51 is also conceivable, which is equipped for higher comfort with a gas spring cylinder or is operated electrically, so that retracting or extending the extendable railing 51 can be done with less power, respectively without element seizure.

Figure 7:
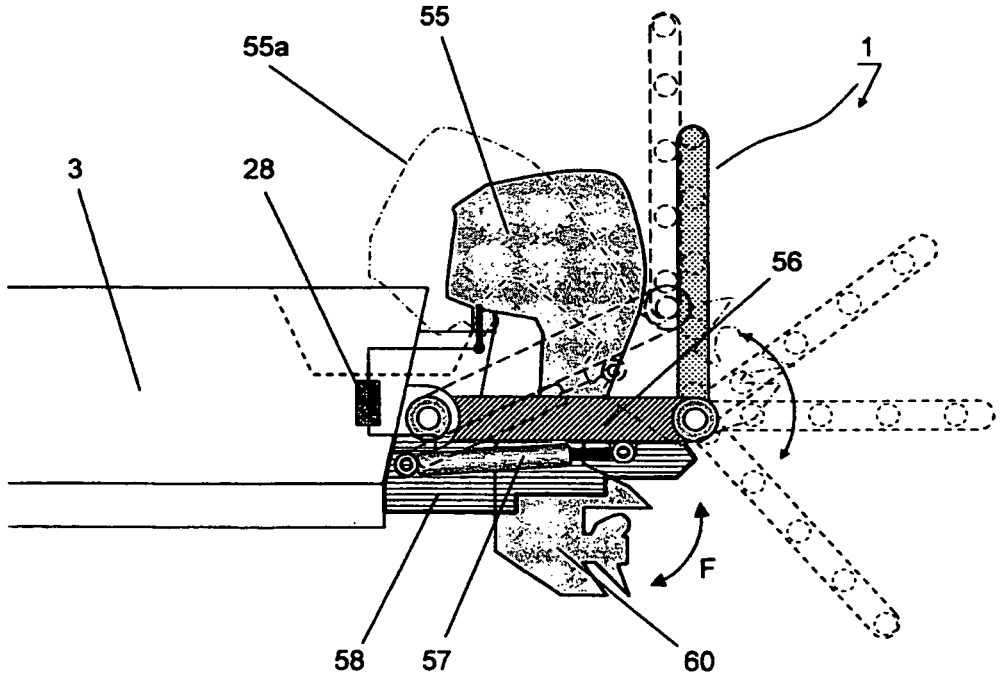

FIG. 7 Shows a schematic sideview of tilting railing 1 at the stern on an outboard driven craft, which by means of a holding arm 56 and a tilting cylinder 57 adjusts the tilting angle of the outboard motor 55 in an emergency situation or and when left parked for a long time, whereby the holding arm 56 is mounted on the stern of the watercraft 3 and underneath a lifting body 58 is additionally fixed and the release of the upswing of the holding arm 56 takes place by means of a contact transmitter 59.

Watercraft 3 with mounted outboard motor 55 do not have the comfort of a lavish bathing platform as craft with inboard motors have, but have at best small stepping areas at the side on which a narrow bathing ladder is attached.

The tilting railing 1 is innovatively fixed on a holding arm 56 that is mounted on the stern of the watercraft 3 and is held in the appropriate position by a tilting cylinder 57. The railing 1 is placed in such a manner that there is adequate space for steering and trimming the outboard motor 55 and in addition to that, when cruising, requires additional space so as to be able to immediately lift up the entire underwater part 60, should the underwater part 60 have collision with an underwater object, thereby safeguarding it from any damage. As soon as the outboard motor 55 carries out a swiveling angle towards the end position of the outboard motors 55*a* due to hitting the sea bottom, a signal is triggered by means of a contact transmitter 59 that releases the tilting cylinder 57 and thereby the outboard motor 55, which is swinging backwards, according to arrow F, lets the railing 1 be immediately swung up so as to give enough space for the underwater part 60. The tilting cylinder 57 can be a gas spring cylinder which, by a remote cable and a mechanical release button, opens the gas valve not shown here and hence serves as a contact transmitter 59, or the contact transmitter 59 is an electronic element which, when pressed, gives a signal to the controller 28 to activate the tilting cylinder 57, which for example functions hydraulically or electrically. The tilting position of the outboard motor 55 in the end position 55*a* also applies if the watercraft 3 is not in use for a longer period of time or if the watercraft 3 gets pulled onto the beach and hence the underwater part 60 will be elevated. If the outboard motor 55 is swiveled back to the normal driving position, then the tilting cylinder 57, in the gas spring cylinder version, can be pushed back manually into the appropriate home position or this takes place hydraulically i.e. electrically, according to the tilting cylinder 57 type.

A lifting body 58 is fixed on the holding arm 56 and acts as a hydrodynamic and static lifting component at the stern of the watercraft 3 and may compensate the weight of the railing 1 when having an appropriate size. In addition it can also house trim tabs and further technical accessories as for example underwater lamps. The holding arm 56 can also be fixed on the lifting body 58 if this is firmly connected to the watercraft 3. In addition a pusher 41 can also be fixed to the holding arm 56 so that the railing 1 is appropriately shifted horizontally and the cylinder 37 could be substituted by the tilting cylinder 57.

Of course the invention is not only applicable on shown and described examples.

DRAWING LIST

1 railing
2 swim platform
3 watercraft
4 frame
4*a* second handle
5 rung
6 swivel mechanism
7 holding mean
8 synchronization bar
9 swiveling drive
10 emergency switch
11 emergency pull rope
12 up/down switch
13 current wire
14 footstep
14*a* safety footstep
15 safety hinge
16 pivot shaft
17 pivot mean
18 axis
19 head
20 retainer
21 spring
22 linear drive
23 cog wheel
24 small wheel
25 pivoting shaft
26 large wheel
27 swiveling motor
24, 26 wheel set
28 controller
29 rotary encoder
30 shaft bearing
31 inner housing
31*a*, 31*b* inner shell
32 cover
33 swiveling plate
34 parallelogram
35 console
36 rail
37 cylinder
38 holding bar
39 holding rope
40 holder
41 pusher
42 tender
43*a*, 43*b* holding mean
44 chock
45,45*a* tender rail
46 tender sledge
47 sensor
48 tender drive
49 docking station
50 rev counter
51 extendable railing
52 hinge
53 lock
54 lever
55 outboard motor
55*a* outboard motor tilted
56 holding arm
57 tilting cylinder
58 lifting body
59 contact transmitter
60 underwater part
A tilting movement
X start position
Y horizontal position
Z stair position
WL waterline
H1 upstroke
H stroke
K stroke footstep
V vertical position footstep
Q horizontal position footstep
L plumb line
D horizontal movement console
F tilting move outboard motor
DP pivoting point

The invention claimed is:

1. A railing that is capable of being attached to a watercraft, the railing comprising:

a frame;

a swivel mechanism that is configured to rotate the frame from an upright vertical position to a stair position, which is a position between a horizontal position and a downward vertical position that is opposite to the upright vertical position; and a plurality of steps attached to the frame, wherein the plurality of steps can rotate independently to a rotation of the frame.

2. The railing according to claim 1, wherein the plurality of steps can be moved manually or by an adjustment mechanism.

3. The railing according to claim 1, further comprising a handle attached to a side of the frame.

4. The railing according to claim 1, further comprising:

an extendable railing attached to the frame, wherein the extendable railing extends outward when the frame rotates from the upright vertical position to the stair position.

5. The railing according to claim 1, further comprising a drive mechanism that drives the swivel mechanism.

6. The railing according to claim 1, further comprising:

a parallelogram that is attached to the frame and can adjust a height or a horizontal position of the frame.

7. The railing according to claim 1, wherein the plurality of steps can maintain a horizontal position when the frame is at both the upright vertical position and the stair position.

8. The railing according to claim 1, wherein the plurality of steps can maintain a vertical position when the frame is at the upright vertical position and the plurality of steps can maintain a horizontal position when the frame is at the stair position.

9. The railing according to claim 1, wherein each step of the plurality of steps can rotate independently.

10. A watercraft comprising:

a swim platform; and the railing according to claim 1 that is attached to an end of the swim platform, wherein the swim platform and the railing are separate pieces of structure.

* * * * *